United States Patent [19]

Oishibashi et al.

[11] Patent Number: 4,556,164

[45] Date of Patent: Dec. 3, 1985

[54] METHOD OF FIELD WELDING HEAD-HARDENED RAILS

[75] Inventors: Hirotsugu Oishibashi; Katsuyoshi Ueyama; Muneyuki Ohara, all of Musashino; Mitsuo Nakamura, Higashikurume; Takeo Aichi, Kitakyushu; Shigeru Sasaki, Niiza, all of Japan

[73] Assignees: Japanese National Railways; Hakusan Seisakusho Co., Ltd., both of Tokyo; Kyushu Tetsudo Kiki Seizo Co., Ltd., Fukuoka, all of Japan

[21] Appl. No.: 702,442

[22] Filed: Feb. 19, 1985

Related U.S. Application Data

[62] Division of Ser. No. 511,291, Jul. 6, 1983, abandoned.

[30] Foreign Application Priority Data

Dec. 7, 1982 [JP] Japan ..... 57-214418

[51] Int. Cl.[4] ..... E01B 11/50; B23K 11/04

[52] U.S. Cl. ..... 228/199; 228/222; 228/242

[58] Field of Search ..... 228/19, 4.1, 7, 28, 228/44.1, 44.2, 125, 196, 199, 200, 213, 222, 240, 242; 29/56.6, 281.1, 429, 566.1; 104/2, 15; 219/53, 54, 55, 101, 104, 156, 161

[56] References Cited

U.S. PATENT DOCUMENTS

| | | | |
|---|---|---|---|
| 3,138,858 | 6/1964 | Bennewitz | 228/125 |
| 3,184,839 | 5/1965 | Gerlach | 228/125 |
| 3,451,470 | 6/1969 | Herrick | 104/2 |
| 3,456,333 | 7/1969 | Meier et al. | 228/200 |
| 3,595,463 | 7/1971 | Fadieu et al. | 228/125 |
| 4,272,664 | 6/1981 | Theurer | 219/53 |

*Primary Examiner*—Kenneth J. Ramsey
*Assistant Examiner*—M. Jordan
*Attorney, Agent, or Firm*—Wenderoth, Lind & Ponack

[57] ABSTRACT

A method of field welding head-hardened rails which includes the steps of gas pressure welding the rails, shearing off excess metal therefrom at the welded portion with a portable welder device, subjecting the railhead of the pressure welded portion of the rails to a subsequent heat treatment with a gas heater device, setting a width of the pressure welded portion to be heated at the time of the subsequent heat treatment with a pair of jigs, and cooling the portion which has undergone the subsequent heat treatment with an air blowing type cooler.

6 Claims, 13 Drawing Figures

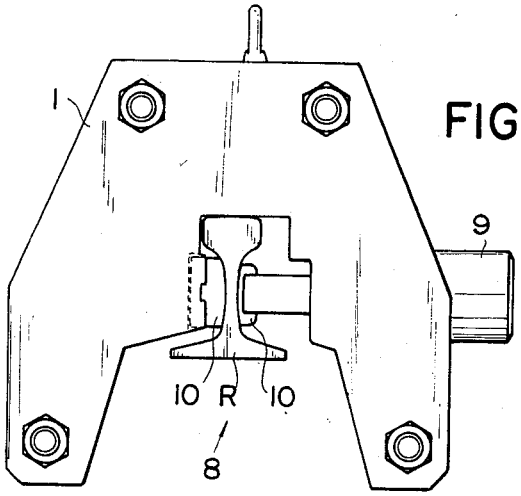
FIG. 3
FIG. 6
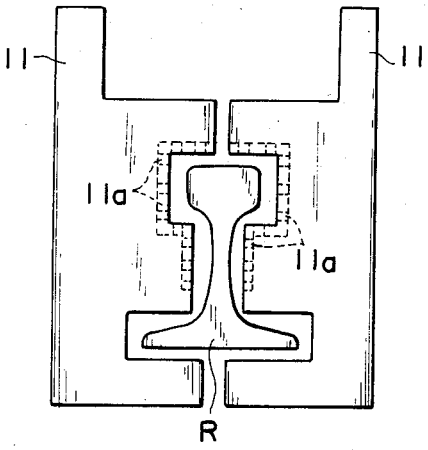
FIG. 9
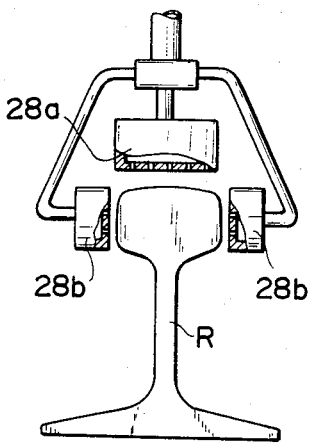

METHOD OF FIELD WELDING HEAD-HARDENED RAILS

This application is a division of now abandoned application Ser. No. 511,291 filed July 6, 1983.

BACKGROUND OF THE INVENTION

1. Field of the Invention

The present invention relates a method of welding head-hardened rails in a rail-laying field.

2. Description of the Prior Art

Recently, there has been found an increased demand for rails having high strength, which has accompanied a tendency toward increased rapid rail transit and an increased railroad volume. As for these high-strength rails, there are included those made of alloy steel and those which have undergone heat treatment. Rails having their railheads alone heat-treated, which are so-called head-hardened rails, find wide acceptance because these are excellent in wear resistance and from an economy.

When rails which are not subjected to heat treatment are welded into a long rail, there have heretofore been adopted various rail welding methods, such as a thermit welding method. However, when the conventional welding methods, such as a thermit welding method, are applied to head-hardened rails, the railheads are tempered at their portions to be welded, have their hardness considerably lowered and lose their wear resistance. For this reason, welding of head-hardened rails, though desired to be carried out, has not materialized and, therefore, head-hardened rails of a given length have been used without giving any modification thereto.

SUMMARY OF THE INVENTION

The present invention has been proposed in order to do away with the present state of things.

An object of the present invention is to provide a rail welding method capable of appropriately effecting in a rail-laying field a series of operations on head-hardened rails, comprising gas pressure welding, reheating and cooling operations.

To attain the object described above, according to the present invention, there is provided a method of field welding head-hardened rails, which utilizes a portable welder for gas pressure welding of rails, a heater for subjecting the railhead of the pressure welded portion of the rails to subsequent heat treatment, a pair of jigs for setting a width of the pressure welded portion to be heated at the time of the subsequent heat treatment, and an air blowing type cooler for cooling the portion which has undergone the heat treatment. The portable welder is provided with means for individually clamping the rails to be pressure welded and applying pressure to the rails in their mutual butting directions, gas heating means for welding the abutting rails under pressure, and punching means for removing excess metal formed on the pressure welded portion. The heater is provided with a truck supported so as to stand straddling the railhead and move above both ends of the rail foot. Reciprocating means (a reciprocator) is attached to frames disposed on the truck. After removal of the excess metal from the welded portion gas heating means are reciprocated by the reciprocating means to heat the railhead. A pair of jigs for being mounted on opposite sides of the welded portion during the heating following removal of the excess metal so to limit the area of heating, is provided each with a top contact portion coming into contact with the top surface of the railhead, side contact portions coming into contact with the side surfaces of the railhead, and a railhead fitting portion defined by the top contact portion and the side contact portions. An air blowing type cooler is provided with an air injection portion for the top surface of the railhead and air jetting portions for the side surface of the railhead to be applied for cooling the welded portion after heating the welded portion with the reciprocating gas heating means.

The aforementioned and other objects and characteristic features of the present invention will become apparent from the description to be given hereinbelow with reference to the accompanying drawings.

BRIEF DESCRIPTION OF THE DRAWINGS

FIG. 3 is a front view showing a stationary clamp retention block of the portable welder.

FIG. 6 is a front view of a burner of the portable welder.

FIG. 9 is a partially cutaway front view showing heating gates of the heater.

DESCRIPTION OF THE PREFERRED EMBODIMENT

Figure 1:
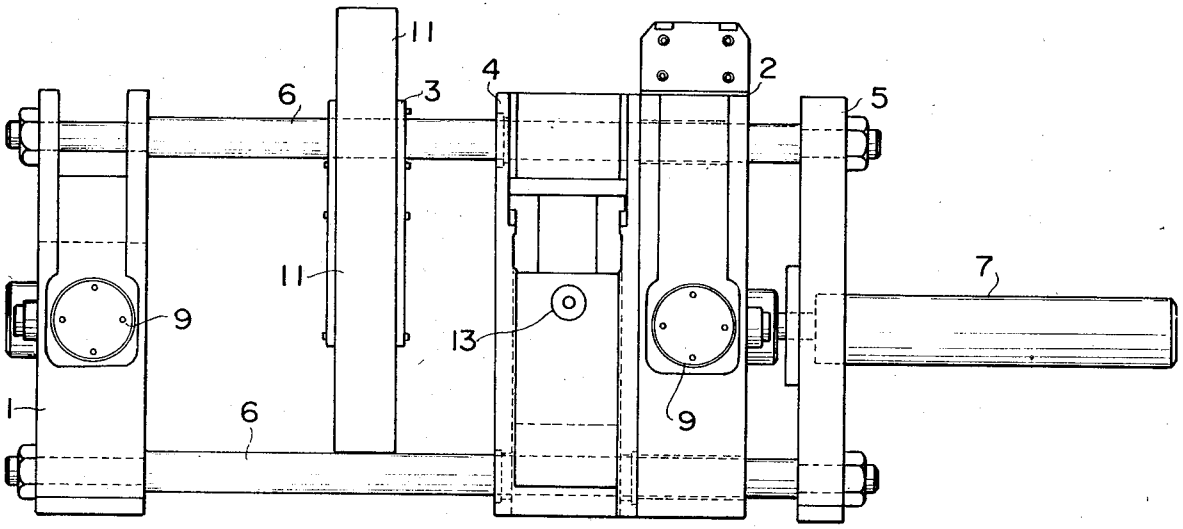
FIG. 1 is a side view illustrating a portable welder for gas pressure welding to be used in one embodiment of the method of field welding head-hardened rails according to the present invention.
Figure 2:
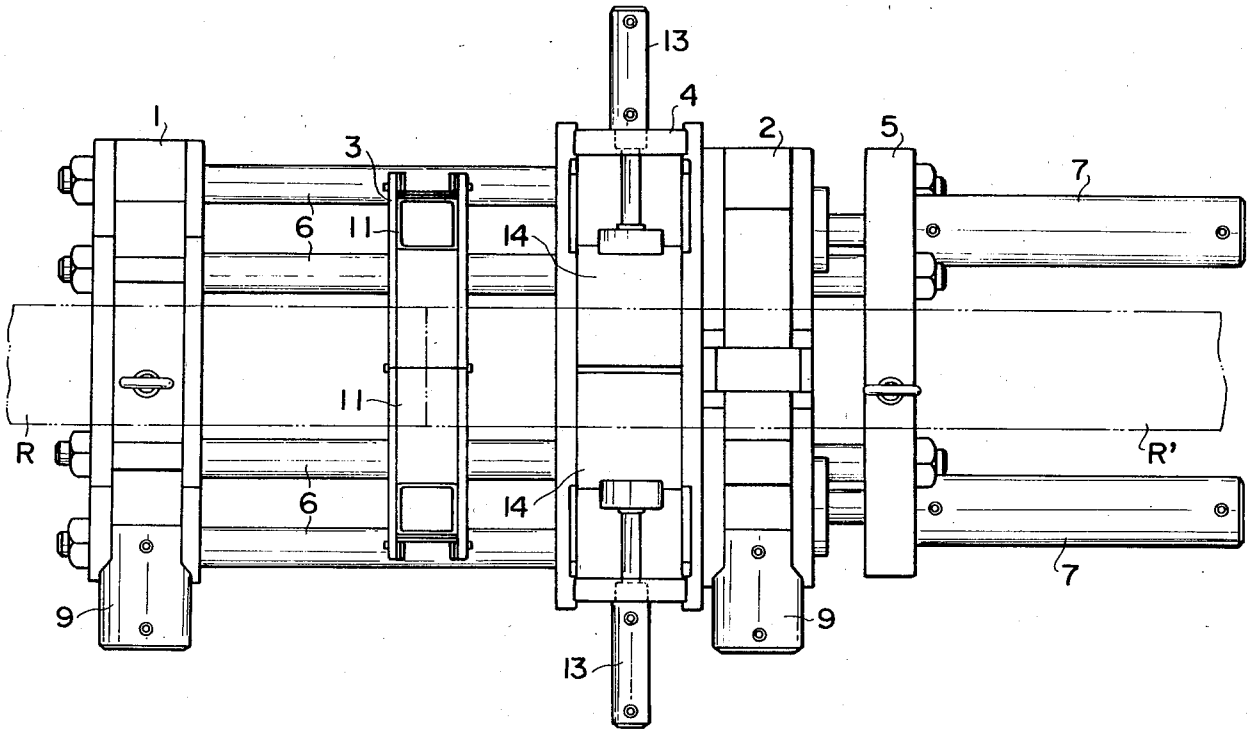
FIG. 2 is a plan view of the portable welder.
Figure 4:
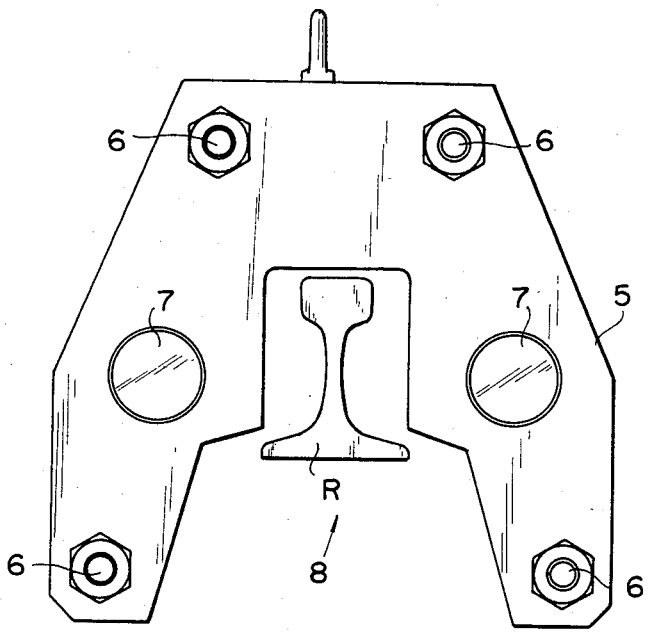
FIG. 4 is a front view showing a retaining block of the portable welder for retaining a pressure cylinder for pressure welding.
Figure 5:
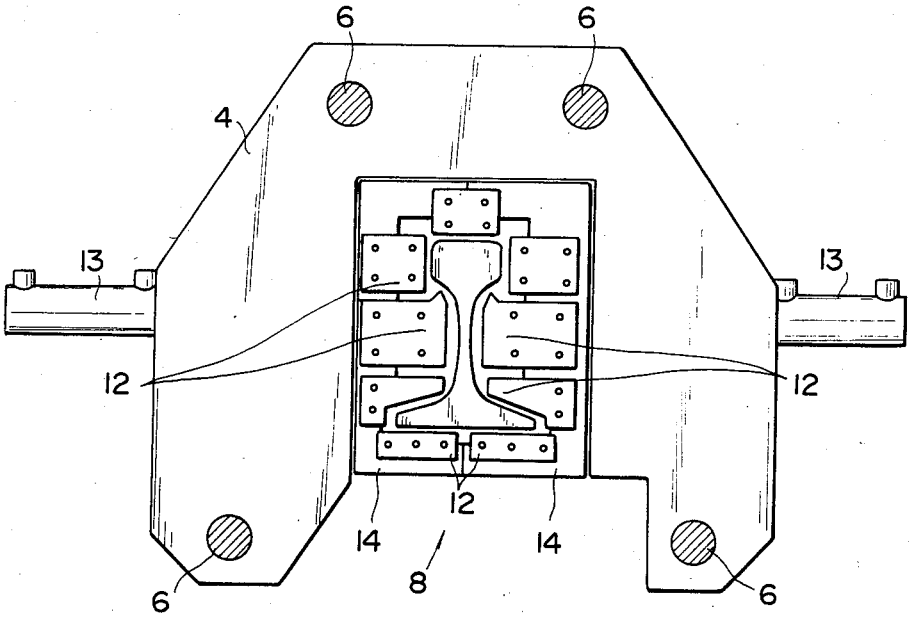
FIG. 5 is a front view showing a punching blade retaining block of the portable welder.

Now, the present invention will be described in detail with reference to the illustrated embodiment.

The field welding apparatus for use in performing the method of field welding head-hardened rails of the present invention comprises a portable welder for gas pressure welding of rails, a heater for subjecting the railhead of the pressure welding portion of the rails to subsequent heat treatment, a pair of jigs for setting a heat width of the pressure welded portion at the time of the subsequent heat treatment, and an air blowing type cooler for cooling the portion which has undergone the heat treatment.

The portable welder for gas pressure welding of rails, developed by the present inventors and disclosed in Japanese Patent Publication No. Sho 53(1978)-4060, is used as a portable welder of the present invention and comprises, as illustrated in FIG. 1 through FIG. 6, a stationary clamp retention block 1 for clamping one of rails R and R', a movable clamp retention block 2 for clamping the other rail, a burner retaining block 3, a punching blade retaining block 4 and a retaining block 5 for retaining a pressure cylinder for press welding. A plurality of parallel guide shafts 6 pierce through these blocks 1, 2, 3, 4 and 5 and thereby these blocks are connected and supported. The stationary clamp retention block 1 is immovably attached to one end of the guide shafts 6, whereas the movable clamp retention block is movably supported by the guide shafts 6 so as to be opposed to the stationary clamp retention block 1. The punching blade retaining block 4 is disposed in front of and attached to the movable clamp retention block 2 6 so as to be movable in conjunction with the movable clamp retention block 2. The burner retaining block 3 is interposed between the stationary clamp retention block 1 and the punching blade retaining block 4 and movably supported by the guide shafts 6. The retaining block 5 for retaining the pressure cylinder for pressure welding is immovably attached to the other end of the guide shafts 6 (behind the movable clamp retention block). A cylinder 7 for pressure welding is attached to the retaining block 5 in parallel to the guide shafts 6 and has its ram connected with the movable clamp retention block 2. With the construction as described above, the cylinder 7 is operated to move both the movable clamp retention block 2 and the punching blade retaining block 4 toward the stationary clamp retention block 1 along the guide shafts 6 and, as described later, effect butt welding of the rails R and R' clamped respectively by the stationary clamp retention block 1 and the movable clamp retention block 2.

All the blocks 1, 2, 3, 4 and 5 constituting the portable welder open downwardly and form a continuous opening 8 for accommodating therein rails R and R' to be pressure welded. Therefore, the portable welder stands straddling the rails.

The stationary clamp retention block 1 and the movable clamp retention block 2 have the same construction and are each provided on their respective sides with a respective pressure cylinder 9 for clamping, as illustrated in FIG. 1. To the leading end of the ram of the pressure cylinder 9, a pair of chucks 10 opposed to each other within the continuous opening 8 are attached so as to clamp the rail web therebetween by means of the functioning of the pressure cylinder 9. In this state, the pressure cylinder 7 is actuated to move the movable clamp retention block 2, thereby butting the end faces of the rails R and R' against each other under pressure. When one of the chucks is movable, the other chuck may be stationary.

The burner retaining block 3 is capable of being divided into two sections with the center of the rail as its center and has a pair of burners 11 which are freely detachably attached thereto. The heating gates 11*a* of the burners 11 are arranged to surround the circumference of the rail, and gas flames from the heating gates heat the portions of the rails R and R' butted under pressure. While excess metal is formed on the circumference of the butted portions of the rails in proportion to the application of pressure, pressure welding is allowed to proceed.

The punching blade retaining block 4 is used in order to shear the excess metal formed on the circumferences of the butted portions of the rails in consequence of the application of heat and pressure to the rails and provided with punching blades 12 which are directed to the entire outer circumferences of the rails along the inner circumference of the continuous opening 8 for accommodation of the rails. These punching blades 12 are attached to a combination of holders 14 capable of being separated from each other relative to the center of the rail. These holders 14 are connected with the rams of cylinders 13 for controlling opening and closing of the punching blades attached to the both sides of the punching blade retaining block 4 and are capable of being moved between their punching positions and their standby positions by means of the cylinders 13. When the rails are to be pressure welded, these holders are opened to be in their standby positions. When the excess metal of the rails is to be sheared off, these holders are closed to allow the punching blades 12 to surround the outer circumferences of the rails, to move under pressure toward the welded portion of the rails in conjunction with the movable clamp retention block 2 by means of the cylinders 7, and to shear off the excess metal formed on the circumference of the welded portion in the course of the movement. After the shearing of the excess metal, the chucks 10 are opened to release the clamping of the rails.

Figure 8:
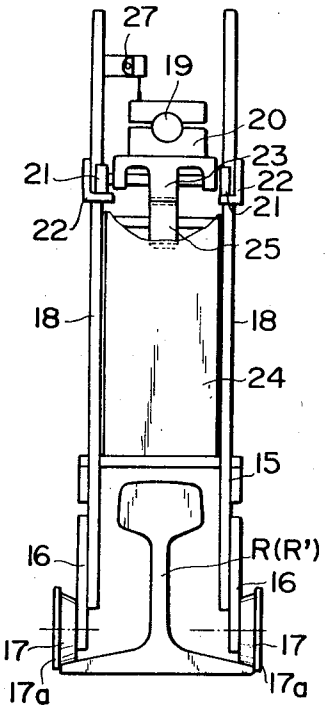
FIG. 8 is a partially cutaway rear view of the heater.
Figure 7:
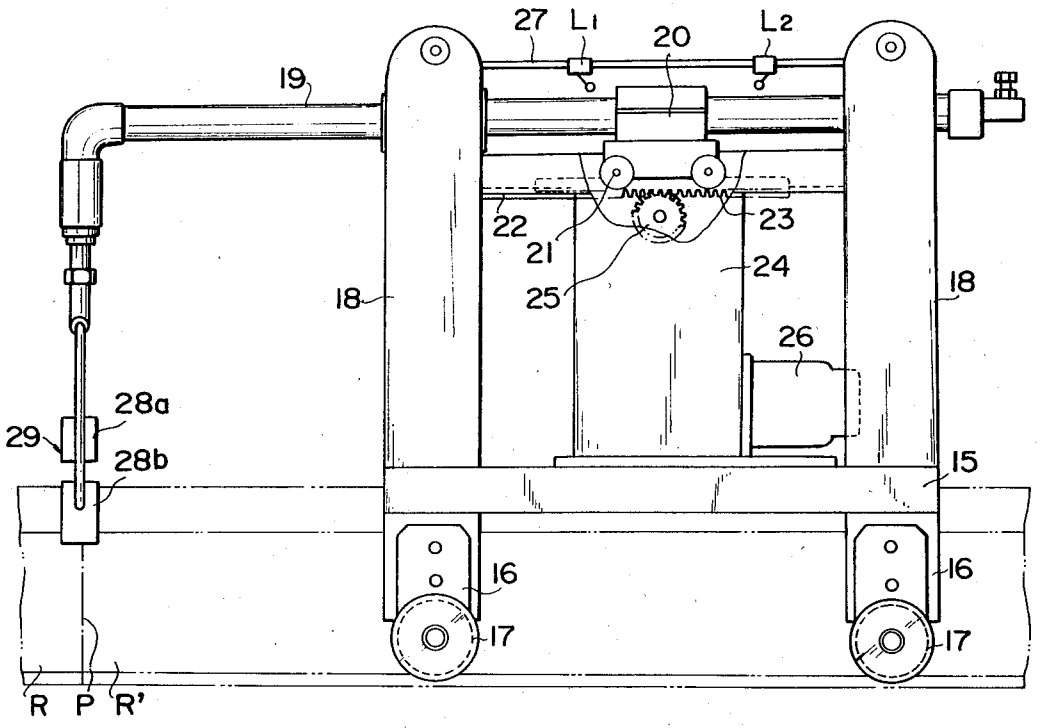
FIG. 7 is a side view illustrating a heater for the railhead to be used in the embodiment of the field welding method according to the present invention.

FIG. 7 to FIG. 9 show a heater for the railhead, which is adapted to subsequently heat the welded portion having the excess metal sheared off. This heater is advantageously used in order to carry out subsequent heat treatment of the softened railhead of the head-hardened rail tempered by the gas heat welding immediately after the punching of the excess metal and to recover the hardness of the railhead, and can fulfill its aimed effects when the rails, which have the excess metal removed therefrom and will be subjected to the subsequent heat treatment, have dimensions which are in the neighborhood of their original dimensions. Since the welded portion of the rails having the excess metal removed therefrom and the vicinity of the welded portion are heated to given temperatures, optimal conditions for immediately effecting the subsequent heat treatment are satisfied. This heater for the railhead will now be described in detail with reference to the drawing figures.

Reference numeral 15 denotes a truck which has two pairs of front and rear support legs 16 extending along the right and left sides of the rail so as to stand straddling the railhead. To each of the support leg 16, a wheel 17 is attached. The truck is supported by the wheels 17 so as to be reciprocatingly movable on the right and left edge portions of the rail foot.

The heater for the railhead, including the truck 15, is prevented from being moved in the rightward and leftward directions, such as by allowing the flanges 17*a* of the wheels 17 to be engaged with the edge portions of the rail foot as illustrated in FIG. 8 or by supporting the support legs 16 on the side surfaces of the rail, for example, thereby effecting control of the widths of the heating gates of the burners for the subsequent heat treatment, which will be described afterwards. Two pairs of front and rear frames 18 rise from the upper surface of the truck 15, and guides 22 are laid between the front frames and the rear frames. A reciprocating member 20 connected to a torch 19 is reciprocatingly moved by superposing the reciprocating member 20 on the guide 22 through a rotor 21, for example.

The reciprocating member 20 is allowed to reciprocate at an optional velocity in accordance with the retaining direction of a motor 26 by allowing a rack 23 formed on the reciprocating member 20 to be engaged with an output gear 25 of a deceleration gear box 24 disposed on the truck 15, rotating the gear 25 by driving the motor 26, and transmitting the rotation of the gear to the rack 23. Above the path of the reciprocating member 20, there are provided reciprocation detecting elements, such as limit switches $L_1$ and $L_2$, which are separated at a prescribed interval. When the reciprocating member 20 moves a prescribed distance in either direction, the limit switch $L_1$ or $L_2$ detects movement of the reciprocating member and consequently allows the motor 26 to be driven in a reverse direction. That is to say, the reciprocating member can be moved within a prescribed range. In other words, the reciprocation of the reciprocating member is set between the limit switches $L_1$ and $L_2$. In order to enable the amount of reciprocation to be set as occasion demands, there is laid a support bar 27 in parallel to the aforementioned guide 22 and the limit switches $L_1$ and $L_2$ are attached to the support bar 27 so that the lateral position of each of the limit switches may be adjusted.

As described above, the burner 29 for the subsequent heat treatment is connected to the reciprocating member 20 via the torch 19 and provided on the leading end thereof with a heating gate **28*a* for heating the top surface of the railhead and heating gates 28*b*** for heating the side surfaces of the railhead.

With the construction as described above, while the truck 15 is moved along the rail, the heating gates **28*a* and 28*b*** are positioned at the welded portion of the rails and opposed respectively to the top surface and the side surfaces of the railhead. As a result, the welded portion of the rails is heated within a prescribed range, with the reciprocating member reciprocated at a prescribed velocity with the boundary of the welded rails at its center.

Figure 10:
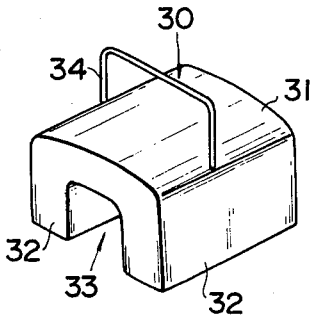
FIG. 10 is a perspective view illustrating a jig for setting a heat width to be used in an embodiment of the field welding apparatus which can be utilized according to the method of the present invention.
Figure 11:
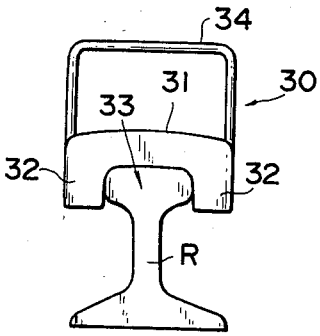
FIG. 11 is a front view of the jig.
Figure 12:
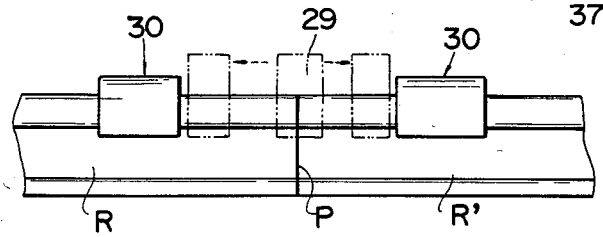
FIG. 12 is a side view showing the state of use of the jig.

A pair of jigs 30 for setting a heat width, as shown in FIG. 10 through FIG. 12, are used in order to determine the width of the welded portion of the railhead to be heated. This jig 30 is made of a metal, formed in the shape of an inverted letter "U", provided on the upper portion thereof with a grip 34, and has a top contact wall 31 having an inner upper surface for coming into contact with the top surface of the railhead, side contact walls 32 having inner right and left side surfaces for coming into contact with the side surfaces of the railhead and a railhead fitting portion 33 defined by said upper and side surfaces. The pair of jigs 30 are disposed at a prescribed interval, as illustrated in FIG. 12, with the rail welded portion P as the center. The aforementioned burner 29 is reciprocated between the pair of jigs 30 to uniformly heat the limited region of the railhead.

The pair of jigs 30 serve not only to interrupt gas flames dispersed along the rail, thereby concentrating the gas flames into the limited region, but also to absorb the heat transmitted from the limited region, thereby preventing the limited region from being further widened. At the time of gas pressure welding of the rails by use of the welder, the railhead in the vicinity of the welded portion is tempered to have its hardness lowered greatly.

The pair of jigs 30 can precisely set the heat-affected zone of the head-hardened rail and prevent the remaining zone thereof from being affected by the heat from the heat-affected zone.

Figure 13:
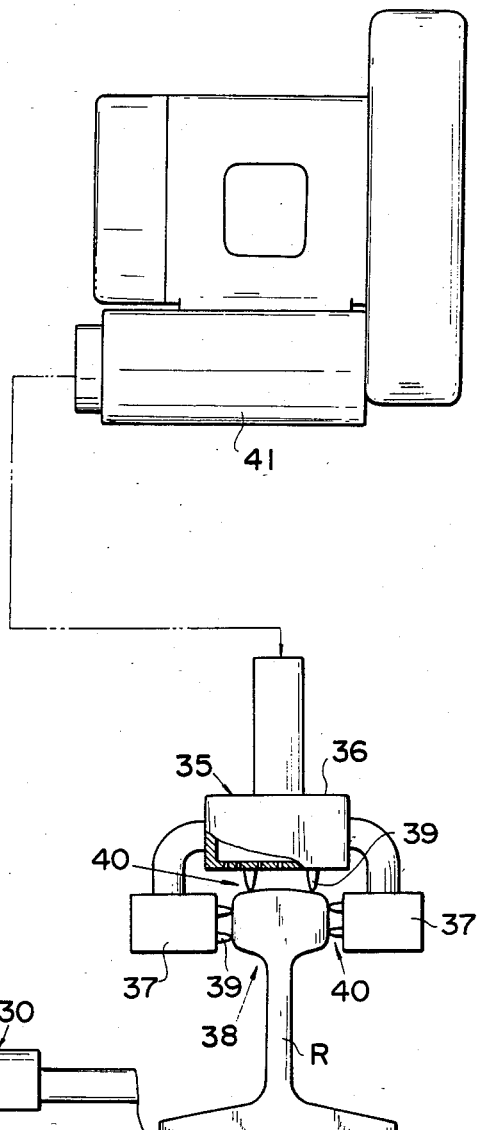
FIG. 13 is a partially cutaway front view illustrating an air blowing type cooler to be used in the embodiment of the field welding apparatus for use in the method according to the present invention.

Immediately after the aforementioned heat treatment, cooling treatment is carried out. FIG. 13 shows a portable air-blowing type cooler 35 for the cooling treatment. The cooler 35 has an air injecting portion 36 for the top surface of the railhead, air jetting portions 37 for the side surfaces of the railhead, and a railhead fitting portion 38 defined by the air injecting portion 36 and the air jetting portions 37. The entire surface of the railhead is supported by spacers 39 which protrude from the air spouting surfaces of the air injecting portion and the air jetting portions to form prescribed spaces 40 between the air injecting portion 36 and the railhead and between the air jetting portions 37 and the railhead respectively.

After the cooler 35 is set above the welded portion of the railhead, as described above, the welded portion is cooled by blowing air from a blower 41. As a result, quenching of the welded portion and the vicinity thereof which have been tempered by the pressure welding has been completed. A series of operations from the pressure welding to the quenching can thus be effected in a rail-laying field.

The portable welder for gas pressure welding used in this embodiment makes it possible to carry out the pressure welding operation in a rail-laying field and to immediately remove under red heat the excess metal formed on the welded portion in consequence of the pressure welding operation by means of punching blades assembled in the welder. Use of this welder provides the following conditions advantageous for the subsequent heat treatment.

In order to allow the gas pressure welded portion to have substantially the same properties as those of the parent metal portion, it is necessary to effect the subsequent heat treatment when the welded portion does not have uneven excess metal and has its dimensions approximating the original rail dimensions as much as possible. Since the welded portion and the vicinity thereof are kept at given high temperatures by immediately punching the excess metal out of the welded rails under red heat, the subsequent heat treatment can advantageously be effected. To be more specific, the rail gas pressure welding is effected at a maximum heating temperature in the range of from about 1200° C. to about 1300° C., the welded portion immediately after the punching of the excess metal is held at a temperature in the range of from 900° C. to 1000° C. and left stand until the temperature is lowered to the range of from 600° C. to 650° C., and then the subsequent heat treatment is effected at this temperature and continues until the temperature becomes in the range of from 1000° C. to 1050° C. Immediately thereafter, the air blowing type cooler is used to complete the quenching.

When the region to be subjected to the subsequent heat treatment and held at a given temperature (600° C. to 650° C.) by heating for the pressure welding, is further immediately heated with gas flames, the railhead is brought to a state wherein the interior thereof has its temperature distribution kept uniformly at a high temperature. When the railhead in this state is cooled by air, it comes to exhibit a desirable fine pearlitic structure throughout the whole thereof. Therefore, the hardness of the welded portion can be recovered. The top surface of the head-hardened rail, which has undergone the pressure welding treatment and subsequent heat treatment of the present invention by use of the welding apparatus described herein, comes to have hardness identical with that of the parent metal of head-hardened rail and exhibit wear resistance and failure resistance and the parent metal exhibits by nature.

According to the present invention, as described above, it is possible to execute the welding of head-hardened rails in a rail-laying field which has not heretofore been carried out, to sufficiently demonstrate the properties of the head-hardened rails, and to considerably promote efficiency in the execution of rail welding and in rail-laying work.

What is claimed is:

1. A method of field welding head-hardened rails, comprising the steps of:

a. clamping and pressing together in abutting relation two rails to be welded together, with a portable welder device;

b. gas heating the two rails with the portable welder device where the two rails abut while pressed together by the portable welder device, so as to pressure weld the rails together to form a pressure welded portion of the two rails where the two rails abut;

c. punching excess metal formed on the pressure welded portion with the portable welder device so as to remove the excess metal on the pressure welded portion, immediately following said step of gas heating;

d. positioning a pair of metal jigs, having respective fitting portions each defined by a respective top contact portion and side contact portions, over the respective ones the two rails on opposite sides of the welded portion with the top contact portions in contact with the top surface of the respective rails and the side contact portions in contact with the respective side surfaces of the rail;

e. straddling the rails after said punching step with a truck of a heater device on a foot of the two rails;

f. after said straddling step and said positioning step, reciprocating a gas heater over the welded portion with a reciprocator attached to frames on the truck so as to heat treat the portion of the two rails, including the welded portion, between the pair of metal jigs; and g. immediately after said reciprocating step, cooling the welded portion with an air blowing type cooler by disposing the cooler over the welded portion so as to have an injection portion of the cooler over the top surface of the welded portion and air jetting portions opposing the sides of the welded portion, blowing cooling air onto the top surface through the injection portion and jetting the air through the jetting portions.

2. A method as in claim 1, wherein said step of punching comprises the step of shearing the excess metal from the welded portion with punching blades of the portable welder device.

3. A method as in claim 1, wherein said step of gas heating is performed at a maximum heating temperature in the range from about 1200° C. to about 1300° C., and said step of reciprocating a gas heater is initiated when the temperature of the welded portion is in a range of from 600° C. to 650° C. and continued until the temperature of the welded portion has a temperature value in the range 1000° C. to 1050° C., said step of punching being performed while the welded portion is red hot.

4. A method as in claim 3, wherein said step of punching comprises the step of shearing the excess metal from the welded portion with punching blades of the portable welder device.

5. A method as in claim 1, further comprising the step of unclamping the portable welding device from the two rails after said step of punching.

6. A method as in claim 1, wherein said step of positioning is performed after said step of punching.

* * * * *